US009435598B2

(12) United States Patent
Seckman

(10) Patent No.: US 9,435,598 B2
(45) Date of Patent: Sep. 6, 2016

(54) WIRELESS DUAL MODULE SYSTEM FOR SENSING AND INDICATING THE AMMUNITION CAPACITY OF A FIREARM MAGAZINE

(71) Applicant: Randall Seckman, Alexandria, VA (US)

(72) Inventor: Randall Seckman, Alexandria, VA (US)

( * ) Notice: Subject to any disclaimer, the term of this patent is extended or adjusted under 35 U.S.C. 154(b) by 0 days.

(21) Appl. No.: 14/476,924

(22) Filed: Sep. 4, 2014

(65) Prior Publication Data

US 2016/0069629 A1 Mar. 10, 2016

(51) Int. Cl.
*F41A 9/62* (2006.01)
*F41A 19/01* (2006.01)

(52) U.S. Cl.
CPC . *F41A 19/01* (2013.01); *F41A 9/62* (2013.01)

(58) Field of Classification Search
CPC ..... F41A 9/62
USPC ..... 42/1.02
See application file for complete search history.

(56) References Cited

U.S. PATENT DOCUMENTS 5,052,138 A * 10/1991 Crain ..... F41A 9/62 42/1.02
5,303,495 A * 4/1994 Harthcock ..... F41A 9/62 42/1.02
5,799,432 A * 9/1998 Wright, Sr. ..... F41A 9/62 42/1.02
5,826,360 A * 10/1998 Herold ..... F41A 9/62 42/1.02
2007/0144396 A1* 6/2007 Hamel ..... F41A 19/01 102/472
2008/0276517 A1* 11/2008 Delgado Acarreta ..... F41A 9/62 42/1.02
2010/0281725 A1* 11/2010 Arbouw ..... F41A 9/62 42/1.02
2011/0252682 A1* 10/2011 Delgado Acarreta ..... F41A 9/62 42/1.02
2012/0167423 A1* 7/2012 Kindt ..... F41A 9/62 42/1.02

OTHER PUBLICATIONS

Inductive Versus Magnetic Position Sensors. Zettlex. <http://mac-con.de/fileadmin/FTPROOT/ZET14_Inductive_versus_magnetic_position_sensors.pdf>. Jul. 21, 2011.*

* cited by examiner

*Primary Examiner* — Gabriel Klein
(74) *Attorney, Agent, or Firm* — Merek, Blackmon & Voorhees, LLC

(57) ABSTRACT

This invention is to a wireless dual module system for sensing and indicating the remaining rounds contained within a detachable or integrated firearm magazine. The dual module system, one containing a display (display module) and one more round sensing modules (magazine module) may be implemented with no significant modifications to the firearm or magazine. The display module and one or more magazine modules wirelessly linked together are referred to as the system. The system is configured to provide the number of rounds remaining in a magazine, if a magazine is seated properly in the magazine, to indicate an empty magazine, or to indicate that the number of rounds remaining in the magazine is above or below a predetermined range. The system is able to provide an immediate indication of the remaining rounds in a magazine, regardless of the amount of rounds discharged or supplemented by the user.

10 Claims, 3 Drawing Sheets

WIRELESS DUAL MODULE SYSTEM FOR SENSING AND INDICATING THE AMMUNITION CAPACITY OF A FIREARM MAGAZINE

BACKGROUND OF THE INVENTION

1. Field of the Invention

This invention relates to system for firearm ammunition display which shows the current count of ammunition in the magazine. The display provides a highly reliable ammunition count of ammunition in a firearm magazine utilizing separate wirelessly linked modules intended to enable the user to view the ammunition count on the remote display module, or when applicable, to other persons such as observers or instructors. Depending on the type of firearm, the magazine module can be designed as a drop-in replacement for the Spring Assembly or as a complete, auxiliary device internal to the magazine.

2. Description of the Prior Art

Safety and tactical issues arise with magazine-fed firearms due to the failure of the user to know or to fully rely on the number of rounds remaining in a magazine ("ammunition count"). Prior attempts to provide such a system are not entirely adequate at measuring round-counts since they can be highly influenced by environmental and mechanical conditions internal or external to the firearm or magazine. Other inventions cannot account for the addition or subtraction of rounds in the magazine without, at times, having to manually reset the device to continue providing an accurate round-count. Additionally, other inventions such as U.S. Pat. No. 5,799,432 require electronic recalibration by either fully inserting, or completely emptying, rounds in the magazine to continuously maintain an accurate round-count. Moreover, other inventions cannot provide an accurate round-count after changing to different capacity magazines since the entire system is either dependent on a defined magazine capacity, or the sensor cannot distinguish between capacities of changed magazines since the round-counting mechanism is based on a firearm-side sensor system such as U.S. Pat. No. 5,142,805. Furthermore, other inventions do not allow for a user-friendly view of the round-count, and which may entail the user to lose field-of-view of potential targets in tactical or other critical situations such as U.S. Pat. No. 5,642,581.

By contrast, in this invention, the use of solid state components and magazine-based sensors overcomes the aforementioned operability issues affiliated with small arms round-counting especially in those devices that operate in harsh environments. Most notably, the present invention utilizes a contactless round-counting technique based upon resonant inductive sensing technology which offers wear-free operation and which is not adversely affected by the presence of liquids, debris, fouling, or cleaning agents common to firearm use. The sensor and other components of this invention are designed for industrial applications that can withstand extensive vibration, shock, magnetism, and temperature variations with negligible transient affects to the round-count.

None of the above inventions and patents, taken either singly or in combination, is seen to describe the instant invention as claimed.

SUMMARY OF THE INVENTION

According to at least one aspect of the invention, the present ammunition count system utilizes a resonant inductive position-sensing coil board driven by a microprocessor, which is mounted to the internal contour of the magazine running the same linear or semi-arced track as the follower. An inductive target mounted to the follower (e.g., a push plate) is inductively coupled with the sensing coil when energized by a microprocessor connected to a low voltage power source. Each round added or removed from the magazine moves the follower (and thus the target) in linear increments relative to an air-gapped stationary position above the sensor coil board. Each stationary position of the target in relation to the sensor coils produces an output to the microprocessor, therefore enabling a precise determination of the target and thus an accurate round-count in the magazine without mechanical or electrical contact.

Another key feature of the invention encompasses a wireless connection between the magazine and a remote display that indicates the amount of remaining rounds in a magazine. An additional significant feature is utilizing modular and embedded design principles which do not interfere with the overall dimensions of the firearm or magazine and also eliminates the need for additional parts or accessories to implement the System. With respect to the modular principle of the ammunition count system, the system can be readily modified to integrate into a host of other firearm types and calibers. Typically, round-counting devices function within the firearm receiver, magazine well, or grip, however the current design allows a prompt deployment of its capabilities to other firearms by using magazine-based sensor systems.

Accordingly, it is a principal object of a preferred embodiment of the invention to . . . .

It is another object of the invention to a non-contact sensor for determining the ammunition count in a firearm magazine.

It is a further object of the invention to an ammunition sensor that can sense whether a round is miss-fed and display the error on a display.

Still another object of the invention is to provide an ammunition sensor that provides an accurate count whether the magazine is engaged or disengaged with a firearm.

It is a further object of the invention to remind a user of the status of ammunition in a firearm and of the possibility of ammunition in the firearm chamber.

It is an object of the invention to provide improved elements and arrangements thereof in an apparatus for the purposes described which is inexpensive, dependable and fully effective in accomplishing its intended purposes.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

Similar reference characters denote corresponding features consistently throughout the attached drawings.

DETAILED DESCRIPTION OF THE PREFERRED EMBODIMENT(S)

The present invention is to an ammunition counting system for a firearm and a display therefor.

Figure 1:
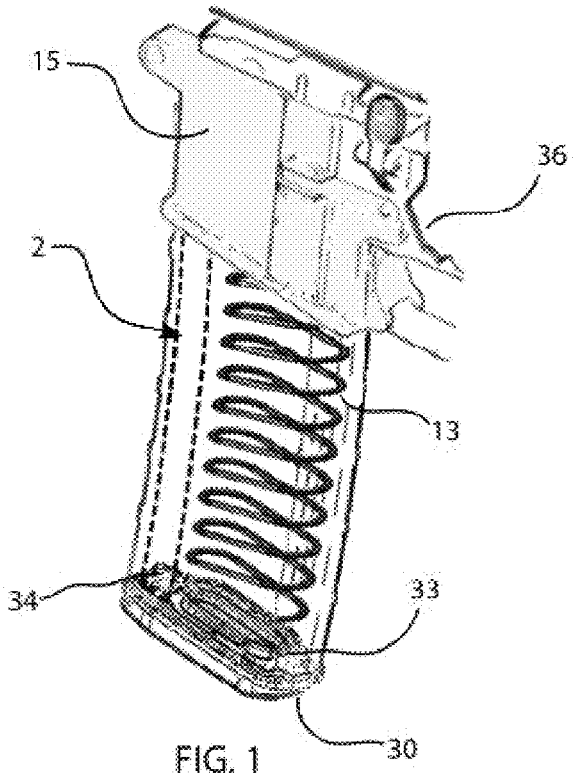
FIG. 1 is a partial cutaway view of the magazine inserted into the magazine well, with the positioning of the magazine module exemplified in accordance with at least one aspect of the invention.
Figure 3:
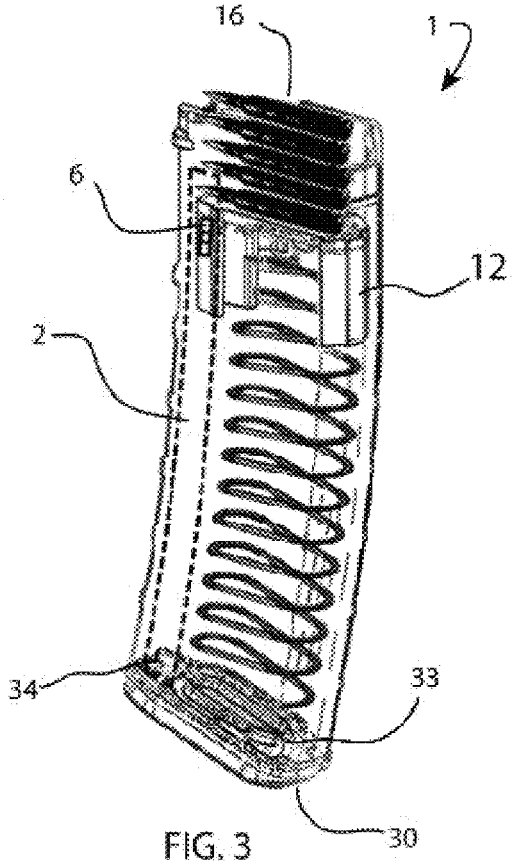
FIG. 3 is a cutaway perspective view of the magazine and magazine module with relevant components depicted in accordance with at least one embodiment of this invention.
Figure 2:
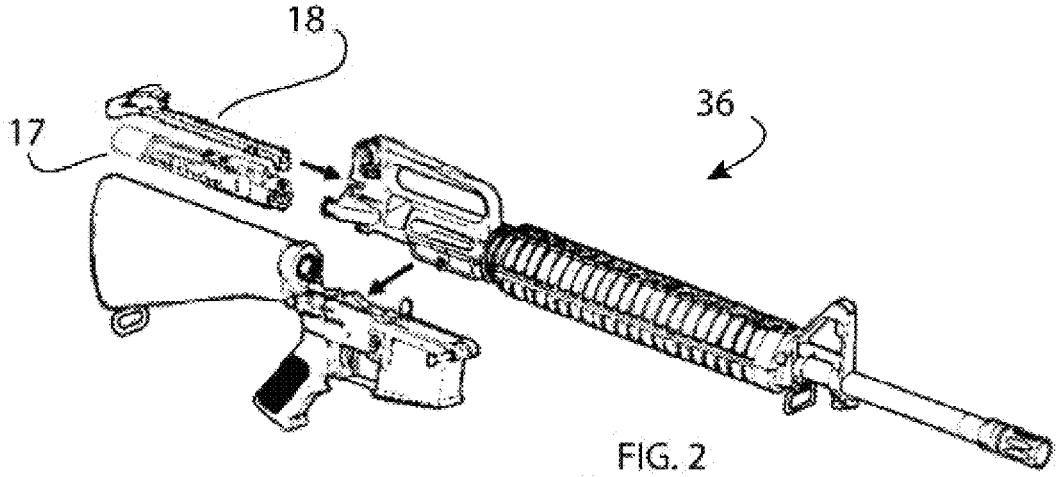
FIG. 2 PRIOR ART
FIG. 2 is perspective view of a firearm and components relevant to at least one embodiment of this invention.

Referring to the drawings, the functioning of the magazine module 2 is represented in FIGS. 1, 2, and 3. A magazine 1 is fully inserted into the magazine well 15 of a magazine-fed firearm 36 and the magazine module 2 is in the vicinity of display module 3 with both modules paired wirelessly via radio frequency (RF) or low frequency (LF) signals. As explained below, the module 2 can be an integral part of the magazine or preferably mountable within the magazine.

Figure 5:
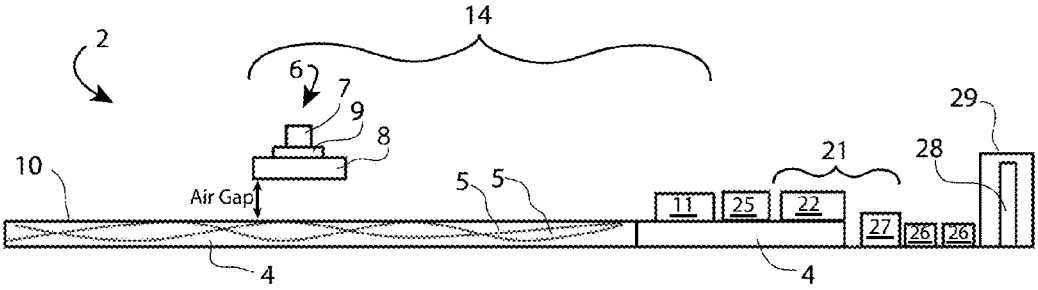
FIG. 5 is a simplified cross-sectional diagram of the magazine module in relation to the target in accordance with at least one embodiment of this invention.

As shown in FIGS. 3 & 5, the sensor module 3 comprises a multilayer printed circuit board (PCB) 4 having printed coils 5 interacting with a microprocessor 11 powered by a battery 28 performing resonant inductive position sensing to track the position of the target 6 without mechanical or electrical contact. The length, width, and arc of the printed coils 5 can vary in order to encapsulate the full range of motion of the target 6 which is dependent upon the varying types of magazines or capacities. The range is most commonly between 10 to 100 rounds for semi-automatic firearms, or three to five rounds for bolt action firearms.

The target 6 includes a housed resonator 7 including a ferrite core inductor 8 and capacitor 9 whose position is measured relative to the printed coils 5. A number of separate printed coils 5, typically three, are embedded in a multi-layer PCB board 4 utilizing conventional technology. The printed coils 5 consist of an excitation coil for powering the resonator 7 inside the inductively coupled target 6, and two coils (sine and cosine) for measuring signals returned from the resonator 7.

The target 6 is positioned over the linear center of the coil board 10 with a small air gap. The microprocessor 11 interacts with the printed coils 5 to power the resonator 7 and to detect the signals that it returns from the target 6.

The detected amplitudes of these return signals are processed to calculate the precise position of the target 6. Sensing and calculations performed by the microprocessor 11 are fully ratio-metric and are immune to the expected changes in air gap and misalignments of the target 6. The target 6 is preferably embedded within or on the surface of the follower ("pusher plate") 12, but it may also be suitable for mounting on the magazine spring 13 or other positions in which it can yield the necessary range of output from the movement of the target 6. The electromechanical interaction of the target 6, microprocessor 11, and printed coils 5 providing sensing and calculation is referred to as the sensor ("ammunition count sensor") 14. A potentiometer or other device may be used to determine the exact position or to determine the position of the target (and thus the follower/pusher plate) relative to a known position to calculate the number of rounds in a magazine or changes thereto.

The exact mounting and positioning of the target 6 and the magazine module 2 within the magazine 1 can vary since the positioning is dependent upon the type of magazine 1. However, a preferred option is anchoring the component end of the PCB 4 between the floor plate 30 and spring plate 33 with a fitted metallic tab 34, and whereas the inherent tension of the PCB 4 properly holds the coil board 10 and surface-mounted components to the internal body of the magazine 1. In a preferred embodiment, the "zero" point of the board 4 remains constant, while the length of the lower end (near plate 30) can be made longer for extended magazines or shorter for shorter magazines. In this way the sensor "senses" an empty magazine consistently from magazine to magazine but can "count" ammunition to the length of the lower portion of the board 4.

In one preferred example, the sensor 14 in FIG. 5, a CambridgelC model CAM204B Central Tracking Unit (prior art), is utilized as the position sensor 14. The CTU implements the electronic processing for resonant inductive position sensing, operating on a center frequency of 187.5 KHz, and measures the position of the inductively coupled target 6 to a precise location, such as TDK's EPC series ferrite core inductors (prior art), relative to a custom shaped coil board 10 tailored for each magazine variant. As discussed above, the board can preferably initially recognizes the "zero" position of the target as having no ammunition, and "count" ammunition as the target moves from the zero position. In this way, the sensor does not have to be "reset" or measured to determine the size of the magazine prior to operation, but initially recognizes the base position for counting ammunition.

Figure 4:
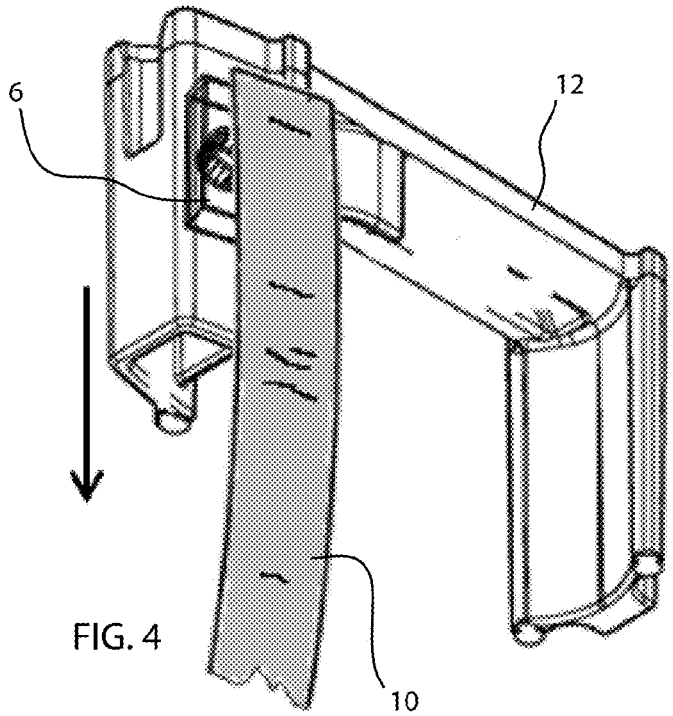
FIG. 4 is a lower perspective view of the follower in relation to the target as relevant to at least one embodiment of this invention.

As represented in FIGS. 2, 3 and 4, the sensor 14 is preferably removably fixed to the internal contour of the magazine 1 running in the linear or semi-arced trajectory of the target 6 mounted on the follower 12. As each round 16 of ammunition is added or removed from the magazine 1, whether manually, or by ejection of the round(s) 16 through firing, or by pulling a bolt assembly 17 to the rear via a charging handle 18 as referenced in FIG. 2, the follower 12 (hence target 6) moves in minor increments in relation to the printed coils 5, which provide the necessary modulation in respect to changes in the round-count to the microprocessor 11. The microprocessor 11 calculates the modulation into a position and movement measurement of the target 6 in relation to the printed coils 5, hence providing an analog-to-digital signal generated by the sensor 14 for an accurate round-count.

In accordance with a preferred embodiment of the invention, a typical 30-round capacity double-stacked M4-type magazine 1 is utilized, and whereas a vertical displacement occurs to a follower 12 (hence target 6) in relation to the magazine spring 13 of no less than 1.5 mm, or greater than 2.8 mm, when the magazine 1 is fully inserted into the magazine well 15. This is due to the rounds 16 or follower 12 being displaced when either comes in contact with, and rests against, the bolt assembly 17 in its forward position. Thus a magazine 1 not fully inserted in the magazine well 15 with the bolt assembly 17 in its forward position will station the follower 12 less than the 1.5 mm threshold in its linear track. This threshold indicates to the sensor 14, which is preprogrammed to provide differential outputs based on the incremental displacement of the follower 12 that the magazine 1 is or is not properly inserted. Rounds 16 then added to the magazine 1 capacity after proper insertion provides approximately 4 mm linear displacements of the follower 12 in relation to the travel of the magazine spring 13. It should be noted that the board 4 may be curved or arcuate and can count the travel distance relative to this curve path for non-linear magazines.

Regardless of the magazine's 1 inserted or detached condition in the magazine well 15, displacement thresholds will not exceed that of which if an additional round 16 would be added to the magazine 1 capacity thus maintaining a threshold for sensor 14 to provide an accurate round-count. This threshold also allows the round-count and magazine 1 insertion condition to be distinguished by the sensor 14. Each successive round 16 added to the capacity of the magazine 1 will move the follower 12 (hence target 6) in equally spaced increments relative to the coil board 10 to provide an increasing round-count for the sensor 14. This process operating in reverse, initiated by the removal of rounds 16 from the capacity of the magazine 1, will ultimately subtract from the round-count.

Concerning this invention's round-counting and indication characteristics, the sensor 14 in the magazine module 2 can be optimized to detect if the rounds 16 remaining in the magazine 1 are not within each set stationary range of the target 6 in relation to the coil board 10. If the round-count falls out of these set ranges, the microprocessor 11 can be programmed to indicate an 'error' to the display 19. These programmed ranges can also apply an 'error' to the display 19 under other erroneous operating circumstances such as misalignment of the follower 12, or double-fed or canted rounds negatively affecting the correct positioning of the follower 12. If the display module 3 is not receiving data from power or signal loss, a 'no signal' indication can be displayed.

Additionally, a common firearm safety practice is to assume that the firearm 36 is always loaded, therefore the display module 3 is adapted to display the round-count as a multi-digit number (ex. 30, if thirty rounds remain in the magazine) followed by '+1' (ex. 30+1) in recognition of this safety practice. If the magazine 1 is empty, only a '+1' is preferably displayed. This "+1" acts a reminder to the user that the possibility exists that a round remains in the chamber. In a less preferred embodiment, a chamber sensor acting in concert with the ammunition count sensor can sense whether a round is in the chamber by physical means or by counting ammunition and may eliminate the "+1" indicator when no round is determined to be in the chamber.

The microprocessor 11 sends the aforementioned digital signal output representing the round-count or error indication to a connected communications device 21. The communications device 21 can be mounted on the same PCB 4 as the sensor 14 as referenced in FIG. 5, or mounted on a separate PCB 4 electrically connected to the Sensor 14. Although not preferred in most tactical applications, the additional sensors of a magazine module 2 or display module 3 may indicate supplemental information such as battery level, received signal strength level, temperature, or other derived data.

In many cases, peripheral devices such as the sensor 14 cannot be managed solely by the communications device 21 as represented in FIG. 5, therefore the communications device 21 may utilize a dedicated microcontroller 25 electrically connected to the microprocessor 11 to properly interface the output produced by the sensor 14, or to perform additional signaling or power management functions.

The communications device 21 connected to the magazine module 2 is referred to as the transmitter 22. The transmitter 22 performs data communications from the magazine module 2 to a communications device 21 integrated within the display module 3, referred to as the receiver 23. Both the transmitter 22 and receiver 23 can include RF or inductive communications devices (commonly known as Near-Field Magnetic Communications, NFMC), or a combination of these two devices to provide intermittent short-range and mid-range RF communications depending on a particular situation and power requirement, or to switch to a required communications protocol. Any communications device 21 below stated as a transceiver is used to synonymously in its inherent ability to perform as both as a transmitter 22 and receiver 23.

In one communications device 21 embodiment as represented in FIG. 5, the magazine module 2 utilizes a Freescale Semiconductor, Inc. model FXLC95000CL intelligent motion-sensing platform consisting of a microcontroller 25 with integrated accelerometer 26. The FXLC95000CL acts as a master controller device to an interfaced Microchip, Inc. model MCP2030 Analog Front-End device (prior art) acting as a transmitter 22 providing very low power bidirectional LF communications utilizing an electrically connected PCB-mounted transponder-inductor as an antenna 27. The MCP2030, operating on a center frequency of 125 kHz, sends round-count data to the display module 3 from the microcontroller 25 acquired by the sensor 14. This embodiment reduces board space for the magazine module and lowers power consumption by enhancing management of sensor 14 functions. This embodiment also allows the display module 3 to remain in low power mode until a specific signaling sequence is received from the transmitter 22 which minimizes current draw. Additionally, the embodiment transmitter 22 can support battery-less operation for additional power reduction for the magazine module 2 if requisite.

In another communications device 21 embodiment referencing FIG. 5, the magazine module 2 utilizes the aforementioned NFMC method as a short-range LF transmitter 22 employing a System-on-Chip (SoC) transceiver manufactured by Freelinc, Inc. (prior art) electrically connected to the Microprocessor 11. The SoC operates on a carrier frequency of 13.56 MHz that sends data generated by the Microprocessor 11 by coupling a low-power non-propagating magnetic field between each embedded SoC of the Magazine Module 2 and display module 3. Inductive coils acting as Antennas 27 are connected to each SoC that modulate the magnetic field measured by the SoC in the Display Module 2 to provide a data connection. This communications method, among other positive attributes for tactical situations, greatly reduces radio signature, lowers power consumption, and reduces frequency contention with other communications devices or Systems.

Depending on size constraints and voltage considerations, the power source, such as an industry standard rechargeable LIR2032 (prior art) battery 28 to power the magazine module 2, can be mounted to the floor plate 30 with a battery holder 29 which are electrically connected to the PCB 4. Power can also be supplied through secondary rechargeable batteries electrically connected or surface-mounted on the PCB 4, or a combination of the aforementioned batteries to provide primary and backup power to the System. Further design augmentations may include utilizing internal or externally mounted energy harvesting transducer 31, as represented in FIG. 7, to recharge batteries which may include solar, thermal, or vibration harvesters.

Figure 7:
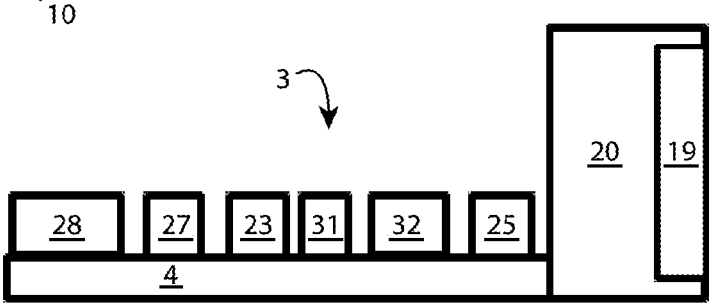
FIG. 7 is a simplified cross-sectional diagram of the display module in accordance with at least one embodiment of the invention.
Figure 8:
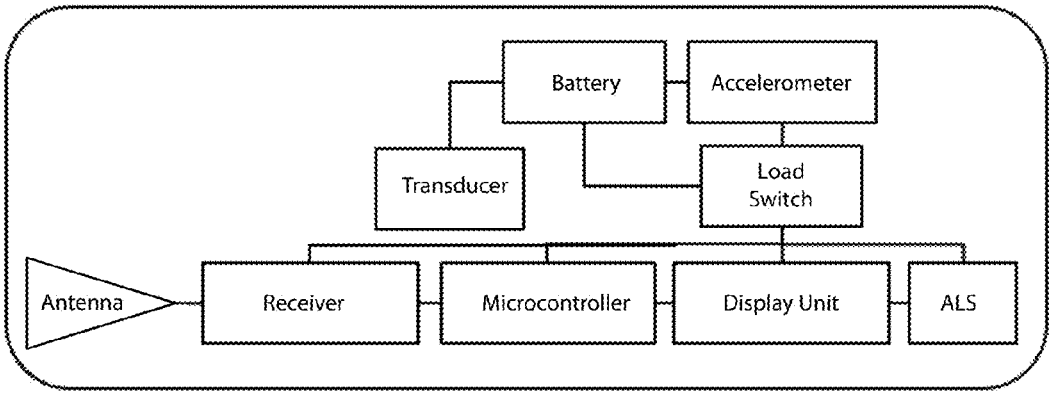
FIG. 8 is a circuit block diagram of display module relevant to at least one embodiment of this invention.

In one embodiment in reference to FIGS. 7 and 8, a Cymbet Corporation model CBC3150 EnerChip with integrated power management (prior art) and charge control is electrically interfaced to a LIR2032 battery 28 and microcontroller 25 to provide power bridging and secondary power for the LIR2032. The CBC3150 also manages the power harvested from energy transducers by interfacing the CBC3150 with an aforementioned Transducer 31. Depending upon the availability of harvested energy, the magazine module 3 and display module 3 can be entirely powered by the CBC3150 with the LIR2032 only serving to provide extended power when the CBC3150 voltage is low.

Figure 9:
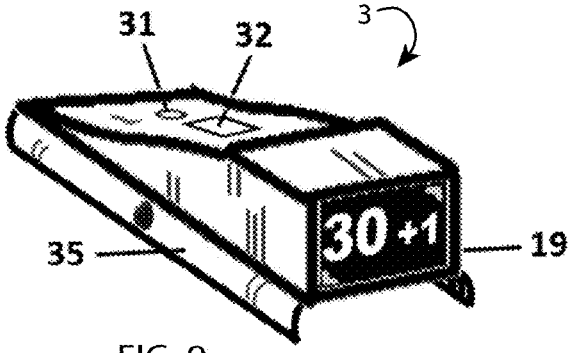
FIG. 9 is a perspective view of a display module concept affixed with a mount in accordance with at least one embodiment of this invention.

In one embodiment of an energy harvesting transducer 31 as represented in FIGS. 7 and 9, an IXYS Integrated Circuits Division model CPC1822 solar energy harvester (prior art) is used consisting of a monolithic photovoltaic string of solar cells mounted to the PCB 4 or on the surface of the display module 3. When the CPC1822 is operated by the presence of sunlight or artificial light, the optical energy will activate the solar cells and generate an output voltage to an electrically connected power management circuit embedded in the CBC3150. The CPC1822 is capable of generating a floating source voltage and current sufficient to trickle-charge the Battery 28.

Figure 6:
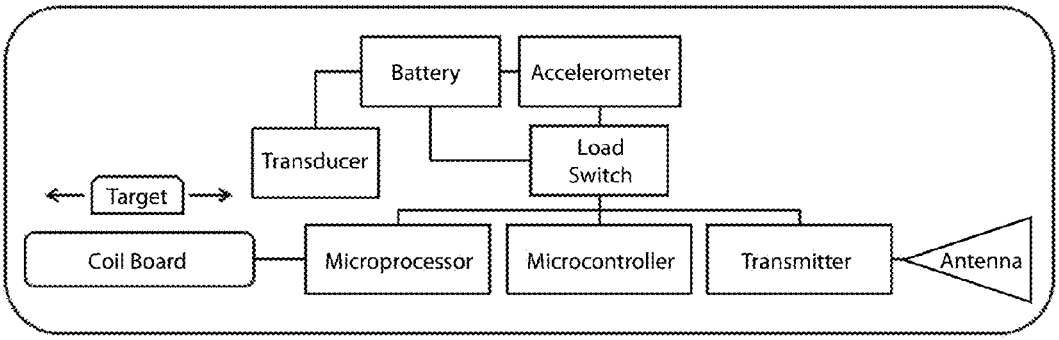
FIG. 6 is a circuit block diagram of a magazine module relevant to at least one embodiment of this invention.

To conserve voltage drain of the battery 28 when the system is not in use, the magazine module 2 and display module 3 can include an accelerometer 26 or other motion activated device electrically connected to the battery 28 and microcontroller 25 to perform system wake-up, on-off switching, and power-down functions, as represented in FIGS. 5 and 6. These functions are initiated by calibrating the accelerometer 26 to predetermined motion thresholds of the magazine module 2 or display module 3 to accommodate the recognition of recoil upon a firearm 36 discharge (shock), the movement when the user changes stances or firing postures (tilt), the movement of the magazine 1 when inserted or removed from the firearm (vibration), and other deliberate motions created by the user such as double tapping of the magazine 1 or firearm 36.

In one accelerometer 26 embodiment as represented in FIGS. 5 and 6, an Analog Device, Inc. model ADXL362 (prior art) ultra-low power three-axis accelerometer 26 in combination with an Analog Devices model ADP195 high-side load switch (prior art) are electrically connected to the microcontroller 25 and battery 28 in the magazine module 2 to create motion-activated switching for the System's communications and Sensor 14 functions depending on the presence or absence of preprogrammed motion thresholds.

As represented in FIGS. 7, 8, and 9, the display module 3 minimally comprises a receiver 23, a microcontroller 25, a display 19 (or display unit 20), and a power source such as a battery 28. The display module 3 can employ the same aforementioned interfaced microcontroller, transceiver, antenna 27, and battery 28 adapted to process incoming wireless round-count data transmitted by the magazine module 2. The display unit 20 can be electrically connected and serially interfaced to the microcontroller 25, or driven by a separate display driver embedded within the display 19. A display unit 20 can include, but is not limited to, Liquid Crystal Display (LCD) or Organic Light Emitting Diode (OLED) technology. The low-profile display module 2 allows its placement within the user's sight picture, such as mounted on the hand-guard or sight rails, using a PICATINNY or other mount 35. The mounting or positioning of the display module 2 is only limited by the maximum communications range of the system. If the display module 2 fails to display the round-count, the user can continue to operate the firearm 36 and magazine 1 independently of the inoperable system.

In reference to FIGS. 8 and 9, the display unit 20 comprises a display 19 utilizing a RiTdiplay Corporation's model USMP-P24701 0.5" OLED display (prior art) with an integrated Solomon Systech model SPD0301 display driver (prior art) electrically connected to the Microcontroller 25. The USMP-P24701 is a preferred OLED-type display due to its small size and low power consumption.

In reference to FIGS. 8 and 9, to optimize display 19 operations under various environmental lighting conditions and to control brightness of the display 19 or backlighting functions, an Ambient Light Sensor (ALS) 32 can be electrically connected to the Display 19. The calibrated ALS 32 calculates the light spectrums of the sun or artificial light, and responds by optimizing the brightness of Display 19.

In one ALS 32 embodiment referencing FIG. 8, a Silicon Laboratories Si1132 ALS is electrically connected to the microprocessor 11 and managed through serial interface to control display intensity or backlight functions. The microprocessor 11 can command the Si1132 to initiate on-demand ambient light sensing and can also place the Si1132 in an autonomous operational state where it performs measurements at set intervals. The Si1132 then interrupts the microprocessor 11 to send ALS 32 data only after each measurement is completed to conserve power consumption of the Display Module 3.

This invention has been described with reference to specific embodiments and accompaniments which are not intended to limit the scope or utility of this invention. Moreover, the electromechanical and electronic designs disclosed herein are not to detract from the overall concept of this invention described in the appended claims.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

I claim:

1. An ammunition count system for a firearm having an ammunition container with a pusher plate for pushing a number of rounds of ammunition from the container to the firearm, said system comprising:

a target attached to the pusher plate, wherein said target comprises a resonator;

said resonator including a ferrite core wound with a coil connected to a capacitor to form said resonator;

a printed circuit board containing patterned coils that are resonantly coupled to the target across an air gap, wherein the patterned coils are shaped to detect the target's movement and position relative to the ammunition container;

a resonant inductive sensing circuit electrically connected to the patterned coils that calculates and digitally outputs scaled numerical values by generating a waveform to inductively power the resonator and to measure the amplitude of return signals relative to the target's position above the patterned coils;

a microcontroller that is electrically connected to the resonant inductive sensing circuit that receives the outputted scaled numerical values and designates said values via firmware of the microcontroller to numerical ranges that correspond with a stationary position of the target in relation to an amount of rounds in the ammunition container to determine the number of rounds of ammunition within the container;

a primary or rechargeable battery electrically connected to the ammunition count system to provide power to the system.

2. The ammunition count system of claim 1, further comprising an accelerometer electrically connected to the microcontroller for providing movement data and system wakeup functioning for the ammunition count system in response to movement, absence of movement, axis of the firearm, or recoil level at programmed thresholds of movement.

3. The ammunition count system of claim 2, wherein said accelerometer further comprises an electrically connected load switch that is controlled through a logic or electrical output from the accelerometer for functioning as a motion-activated switch for the ammunition count system.

4. The ammunition count system of claims 1, further comprising a radio frequency (RF) transceiver with an RF antenna electrically connected to the microcontroller to wirelessly transmit the ammunition count from said microcontroller to a remote RF transceiver having an electrically connected embedded microcontroller and matching RF antenna that are electrically interfaced to a display for viewing said ammunition count.

5. A contactless ammunition count system for a firearm having an ammunition container with a pusher plate pushing a number of rounds of ammunition from the container to the firearm, said system comprising:

said pusher plate having a maximum length of travel along a first pusher plate path from a first full position with a maximum number of rounds inserted into the container to a second empty position with no rounds inserted into the container;

a target attached to the pusher plate, wherein said target comprises a resonator, said resonator including a core wound with a coil connected to a capacitor to form said resonator;

a printed circuit board containing patterned coils that are resonantly coupled to the target across an air gap, wherein the patterned coils are shaped to detect the target's movement and position relative to the ammunition container from the target's first full position to the target's second empty position.

a resonant inductive sensing circuit electrically connected to the patterned coils that calculates scaled numerical values by generating a waveform to inductively power the resonator and to measure the amplitude of return signals relative to the target's current position above the patterned coils to calculate the distance from a baseline to the target's current position;

a microcontroller for determining the current number of rounds of ammunition within the container based on the target's current position;

a display for displaying the determined, current number of rounds of ammunition within the container.

6. The ammunition count system of claim 5, further comprising an accelerometer electrically connected to the microcontroller that provides movement data and system wakeup functioning for the ammunition count system in response to movement, absence of movement, axis of the firearm, or recoil level, at programmed thresholds.

7. The ammunition count system of claim 6, wherein said accelerometer further comprises an electrically connected load switch that is controlled through a logic or electrical output from the accelerometer which functions as a motion-activated switch for the ammunition count system.

8. The ammunition count system of claim 5, further comprising a radio frequency (RF) transceiver (transmitter) with an RF antenna electrically connected to the microcontroller to wirelessly transmit the ammunition count from said microcontroller to a remote RF transceiver (receiver) having an electrically connected embedded microcontroller and matching RF antenna that are electrically interfaced to the display for viewing said ammunition count.

9. The ammunition count system of claim 5, wherein said printed circuit board is curvilinear and includes a shape that follows the first pusher plate path.

10. The ammunition count system of claim 5, wherein said printed circuit board has curved shape that follows the first pusher plate path.

* * * * *